US005630197A

United States Patent [19]

Nishino et al.

[11] Patent Number: 5,630,197

[45] Date of Patent: May 13, 1997

[54] MOUNTING DEVICE FOR INTERCHANGEABLY MOUNTING DIFFERENT TYPES OF PHOTOCONDUCTORS

[75] Inventors: Shinichi Nishino; Osamu Nishino; Toshitaka Ogawa, all of Ibaraki, Japan

[73] Assignee: Hitachi Koki Co., Ltd., Tokyo, Japan

[21] Appl. No.: 642,667

[22] Filed: May 3, 1996

Related U.S. Application Data

[63] Continuation of Ser. No. 407,280, Mar. 20, 1995, abandoned, which is a continuation-in-part of Ser. No. 129,361, Sep. 30, 1993, abandoned.

[30] Foreign Application Priority Data

Sep. 30, 1992 [JP] Japan ..... 4-261187

[51] Int. Cl.[6] ..... G03G 15/00

[52] U.S. Cl. ..... 399/117

[58] Field of Search ..... 355/200, 210, 355/211, 212, 213

[56] References Cited

U.S. PATENT DOCUMENTS

| | | | |
|---|---|---|---|
| 4,231,652 | 11/1980 | Moser et al. | 355/213 |
| 4,273,438 | 6/1981 | Nishikawa | 355/213 X |
| 4,357,093 | 11/1982 | Caudill et al. | 355/200 |
| 4,400,083 | 8/1983 | Beisty et al. | 355/213 |
| 4,598,992 | 7/1986 | Landa et al. | 355/211 |
| 4,655,578 | 4/1987 | Kurtz et al. | 355/212 |
| 4,922,297 | 5/1990 | Kondo | 355/211 |
| 5,008,711 | 4/1991 | Sakamoto et al. | 355/211 X |
| 5,095,334 | 3/1992 | Nukaya | 355/210 |
| 5,142,305 | 8/1992 | Maslanka et al. | 355/213 X |

FOREIGN PATENT DOCUMENTS

| | | |
|---|---|---|
| 2840891 | 5/1980 | Germany . |
| 3146301 | 7/1982 | Germany . |
| 3240026 | 5/1983 | Germany . |
| 4139427 | 6/1992 | Germany . |

*Primary Examiner*—Robert Beatty

*Attorney, Agent, or Firm*—Sughrue, Mion, Zinn, Macpeak & Seas

[57] ABSTRACT

An image forming apparatus includes a base machine; and a mounting device for interchangeably mounting any one of a plurality of different types of photoreceptor units to the base machine. The mounting device includes a print section module detachably mounted on the base machine, with the plural types of photoreceptor units being removably set to the print section module via an interface. The different types of photoreceptor units are different in a mounting structure for mounting a photoconductive layer on base.

10 Claims, 10 Drawing Sheets

MOUNTING DEVICE FOR INTERCHANGEABLY MOUNTING DIFFERENT TYPES OF PHOTOCONDUCTORS

CROSS REFERENCE TO RELATED APPLICATIONS

This is a Continuation of application Ser. No. 08/407,280 filed Mar. 20, 1995, now abandoned which is a Continuation-In-Part of application Ser. No. 08/129,361 filed Sep. 30, 1993, now abandoned.

BACKGROUND OF THE INVENTION

1. Field of the Invention

The present invention relates to an image forming apparatus.

2. Discussion of the Related Art

The photoreceptor (i.e., Photoconductor) unit for use in an image forming apparatus such as a facsimile device, a copying machine or a printer which forms an image by the electrophotographic process is categorized into a drum-shaped photoreceptor formed of a metal tube covered with a photoreceptor layer formed by vapor deposition or coating process, a so-called take-up type photoreceptor constructed such that a sheet-like photoreceptor is removably wound around a tubular support, a so-called clamp type photoreceptor constructed such that an endless photoreceptor is supported on the circumferential outer surface of a tubular support by means of a clamp mechanism provided in association with the tubular support, a belt-type photoreceptor constructed such that a photoreceptor shaped like an endless belt is internally supported by at least two rolls, and others. The photoreceptor materials currently used for the photoreceptor unit are Selenium (Se), organic photoconductive material (OPC), amorphous silicon (a-Si), zinc oxide, and the like.

In grouping plural types of image forming apparatus into different model series on the basis of printing speed, the systems of each different type of the apparatus are used. Accordingly, the cost of production is inevitably increased.

SUMMARY OF THE INVENTION

Accordingly, an object of the present invention is to enable image forming apparatus of different printing speeds or duties to be grouped into different model series, without increasing the production cost.

To achieve the above object, there is provided an image forming apparatus having a photoreceptor in which plural types of photoreceptor units, which are interchangeably set to the base machine of the image forming apparatus, are used for the photoreceptor.

With such a construction, the image forming apparatus can be grouped into different model series without increasing the cost of production.

BRIEF DESCRIPTION OF THE DRAWINGS

The accompanying drawings, which are incorporated in and constitute a part of this specification, illustrate embodiments of the invention and, together with the description, serve to explain the objects, advantages and principles of the invention. In the drawings.

DETAILED DESCRIPTION OF THE PREFERRED EMBODIMENTS

The preferred embodiments of the present invention will be described with reference to the accompanying drawings.

Figure 1:
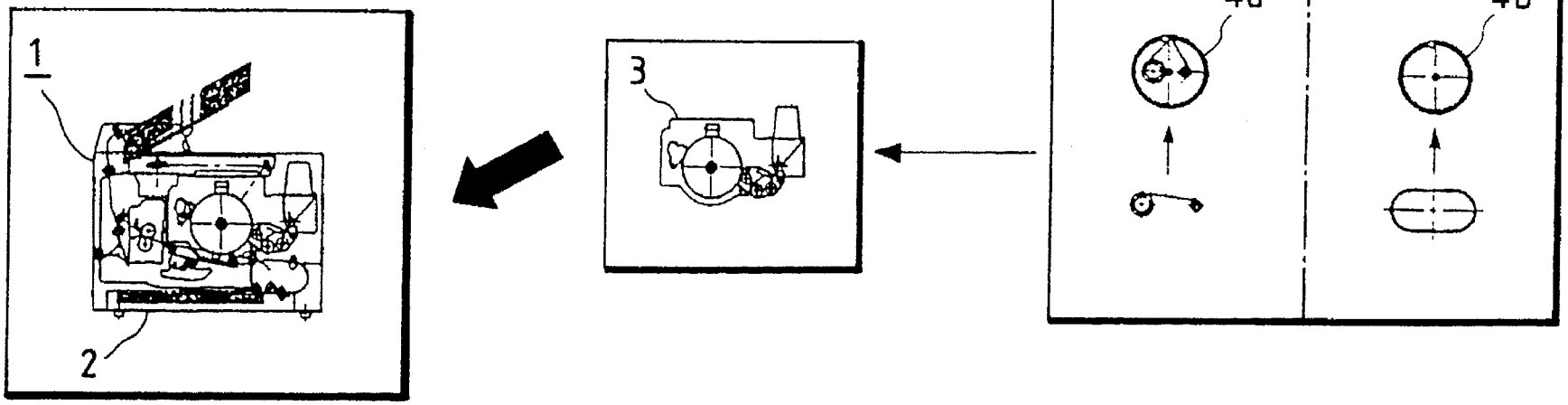
FIG. 1 is an explanatory diagram showing the relationship between the base machine of an image forming apparatus and the photoreceptor unit thereof.

FIG. 1 is an explanatory diagram showing the relationship between the base machine of an image forming apparatus and the photoreceptor unit thereof. The present embodiment employs two types of photoreceptor unit, that is, a take-up type photoreceptor unit 4*a* and a clamp type photoreceptor unit 4*b*. The photoreceptor units 4*a* and 4*b* are removably loaded into a print section module or print module 3 via an interface 38 (see FIG. 10). Loading the print module 3 into a machine frame 2 completes a base machine 1. The print module 3 and interface 38 form a mounting means.

Figure 10:
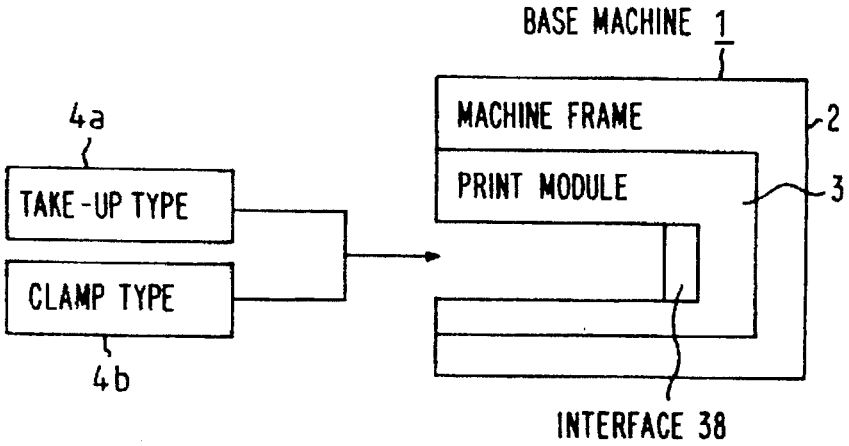
FIG. 10 is an explanatory diagram showing an interface disposed between a base machine and two photoreceptor units.

As shown schematically in FIG. 10, the interface 38 is freely disposed between the print module 3, which is detachably mounted on the base machine 1, and each of the photoreceptor units 4*a* and 4*b*. The interface 38 refers to a coupling portion between the print module 3 and the photoreceptor units 4*a*, 4*b*. The interface 38 is constituted by a mechanical interface such as a gear mechanism which is detachably engaged, etc., which transmits motive power to the photoreceptor unit, and an electrical interface which includes a signal transmission unit for controlling the rotation operation of the photoreceptor unit. More specifically, the mechanical interface performs coupling due to gears 44*a* and 44*b* for transmission of drive force to the photoreceptor units, and the electrical interface performs the engagement of a front frame 21 of the photoreceptor unit with an earth plate 51 (see, for example, FIGS. 2 and 11).

Figure 11:
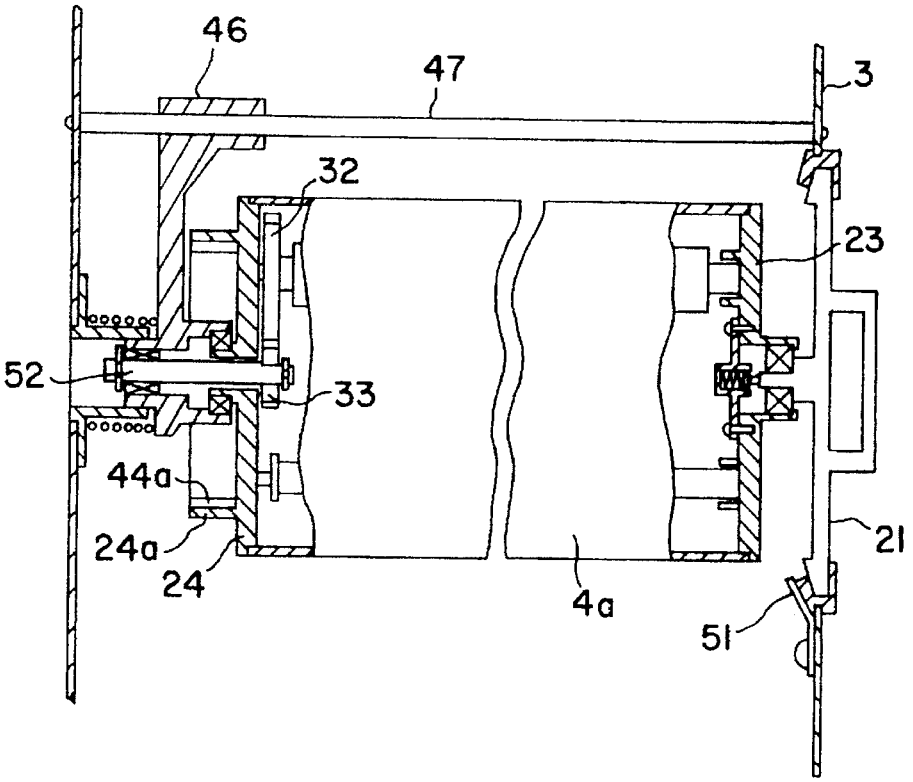
FIG. 11 is a diagram schematically illustrating a main structure in a state where the film take-up type photoreceptor unit 4*a* is fitted to the fitting part provided in the print module 3 for the photoreceptor unit.
Figure 12:
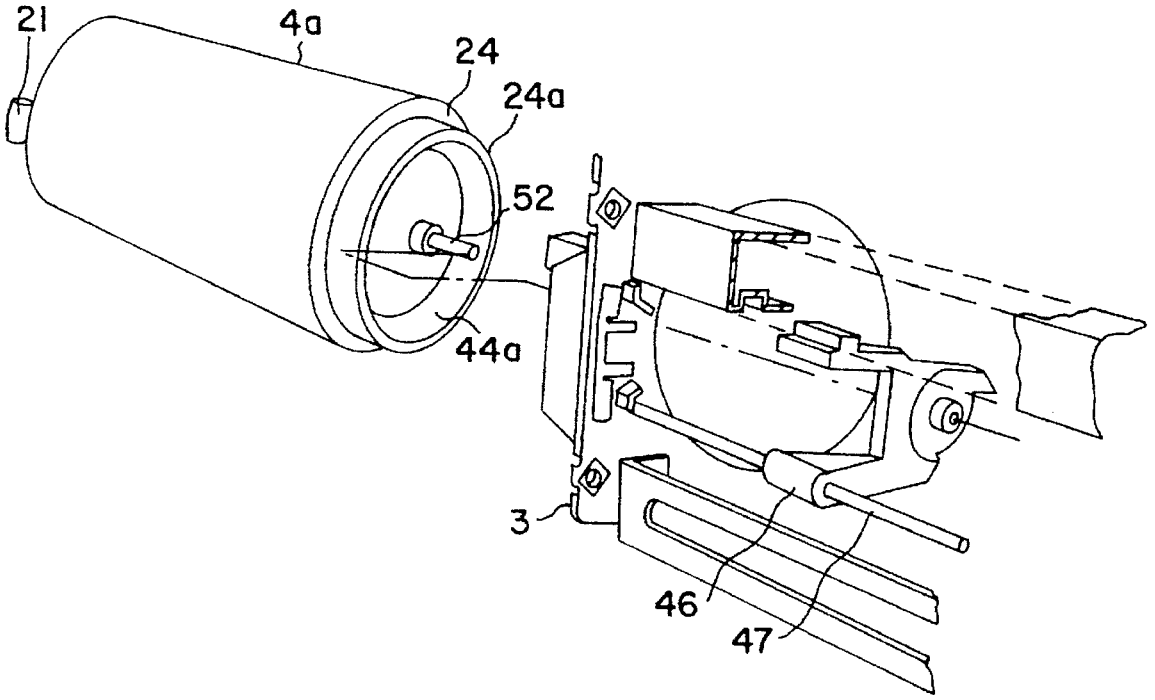
FIG. 12 is a perspective view illustrating a relationship between the print module and the photoreceptor unit.

A detailed description of the interface follows with reference to FIGS. 11 and 12.

FIG. 11 is a diagram schematically illustrating a main structure in a state where the film take-up type photoreceptor unit 4a is fitted to the fitting part provided in the print module 3 for the photoreceptor unit, and FIG. 12 is a perspective view illustrating a relationship between the print module 3 and the photoreceptor unit. As shown in the figures, a cylindrical projection 24a having a center which is coaxial with a drive shaft 52 is disposed on the side surface of a rear cap 24, and the gear 44a is formed in the inner peripheral surface of the projection 24a. The gear 44a is partially engaged with the gear 44b provided in the print module 3 when the photoreceptor is fitted to the print module 3.

A drum rear frame 46 has one end which is supported by a guide shaft 47 fixed to the print module 3 in such a manner that the drum rear frame 46 is slidable along the guide shaft 47. The drum rear frame 46 is used for guiding the photoreceptor unit up to a predetermined position when the photoreceptor unit is being inserted into the print module 3.

The earth plate 51 is fixed to a frame constituting the print module 3 and which is electrically grounded when a tip of the earth plate 51 is engaged with the front frame 21 of the photoreceptor unit.

With respect to the signal transmission unit, it is further contemplated that the signal transmission unit may include, for example, an identifying circuit for discriminating the photoreceptor unit. More specifically, in the case of considering the operational specification by a user, it would be helpful to provide a circuit for discriminating the particular photoreceptor unit and a plurality of control programs in advance. With such a structure, a suitable control program can be automatically changed in accordance with a change of the particular photoreceptor unit chosen by the user.

Figure 13:
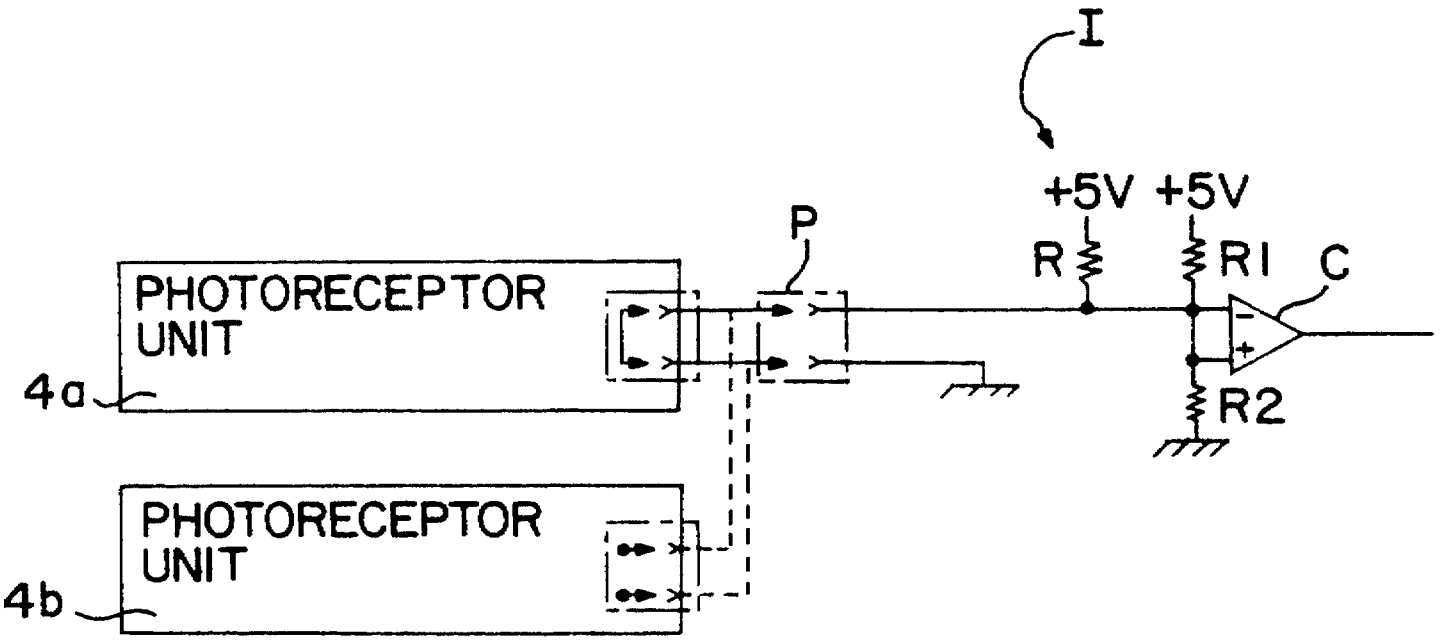
FIG. 13 is an explanatory diagram showing a photoreceptor unit identifying circuit.

FIG. 13 illustrates an example of an identifying circuit for discriminating a photoreceptor unit. In particular, when an output of a comparator C exceeds a predetermined voltage value (for example, 2 V), the identifying circuit I identifies that a photoreceptor unit 4b is used, and when the output of the comparator C is lower than the predetermined voltage (2 V), the circuit I identifies that a photoreceptor unit 4a is used.

The photoreceptor unit (4a, 4b) and the identifying circuit I can be readily connected through a known plug-in identifying means P such as a PC card or a connector.

Figure 2:
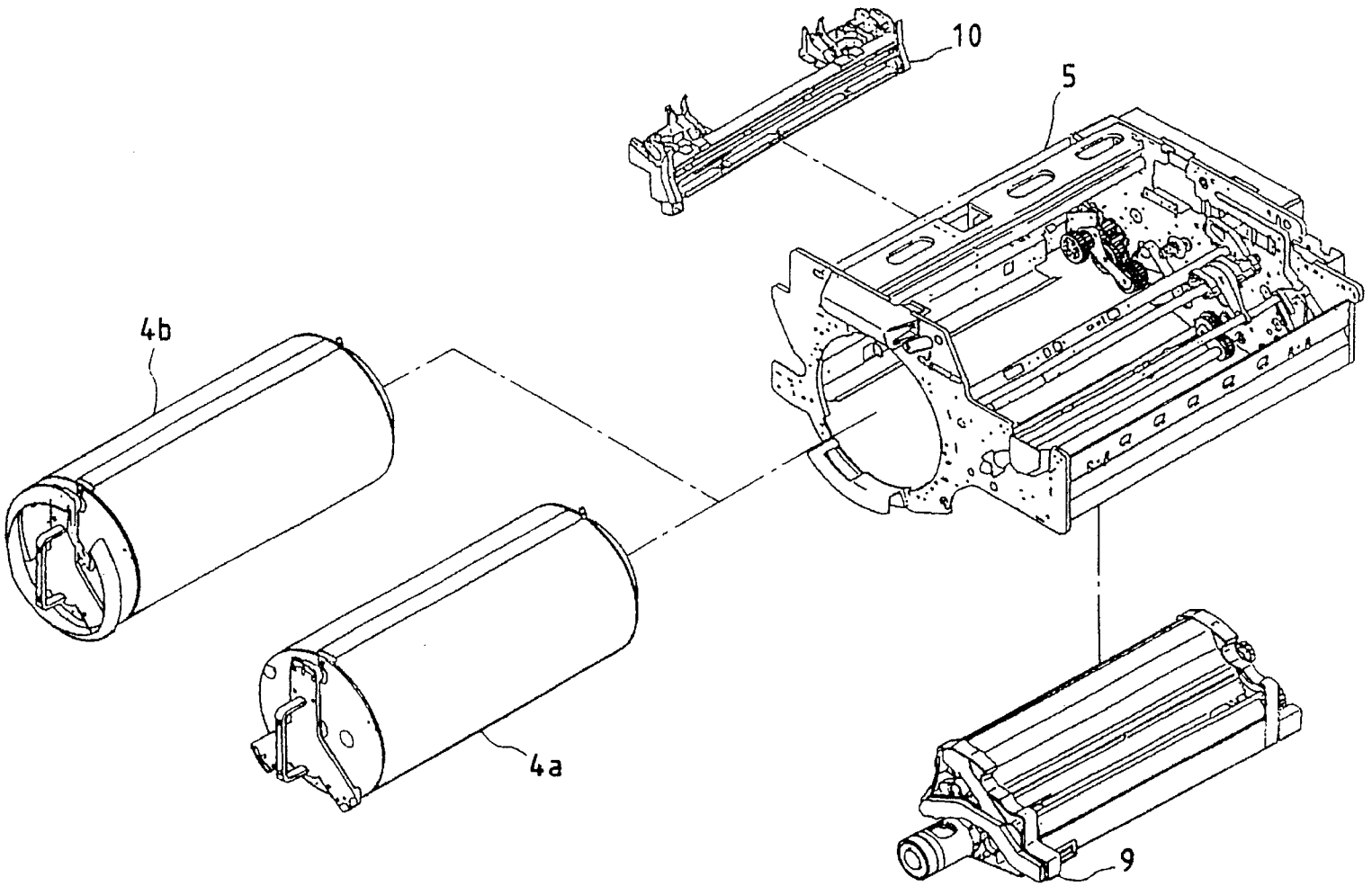
FIG. 2 is an exploded view in perspective showing the construction of a print module of FIG. 1.

In the exploded perspective view of the construction of the print module 3 as shown in FIG. 2, a developing unit 9 and a cleaner unit 10 are set to a print frame unit 5. Additionally, the take-up type photoreceptor unit 4a or the clamp type photoreceptor unit 4b, both having substantially the same external shapes, is selectively inserted into the print frame unit 5.

Figure 3:
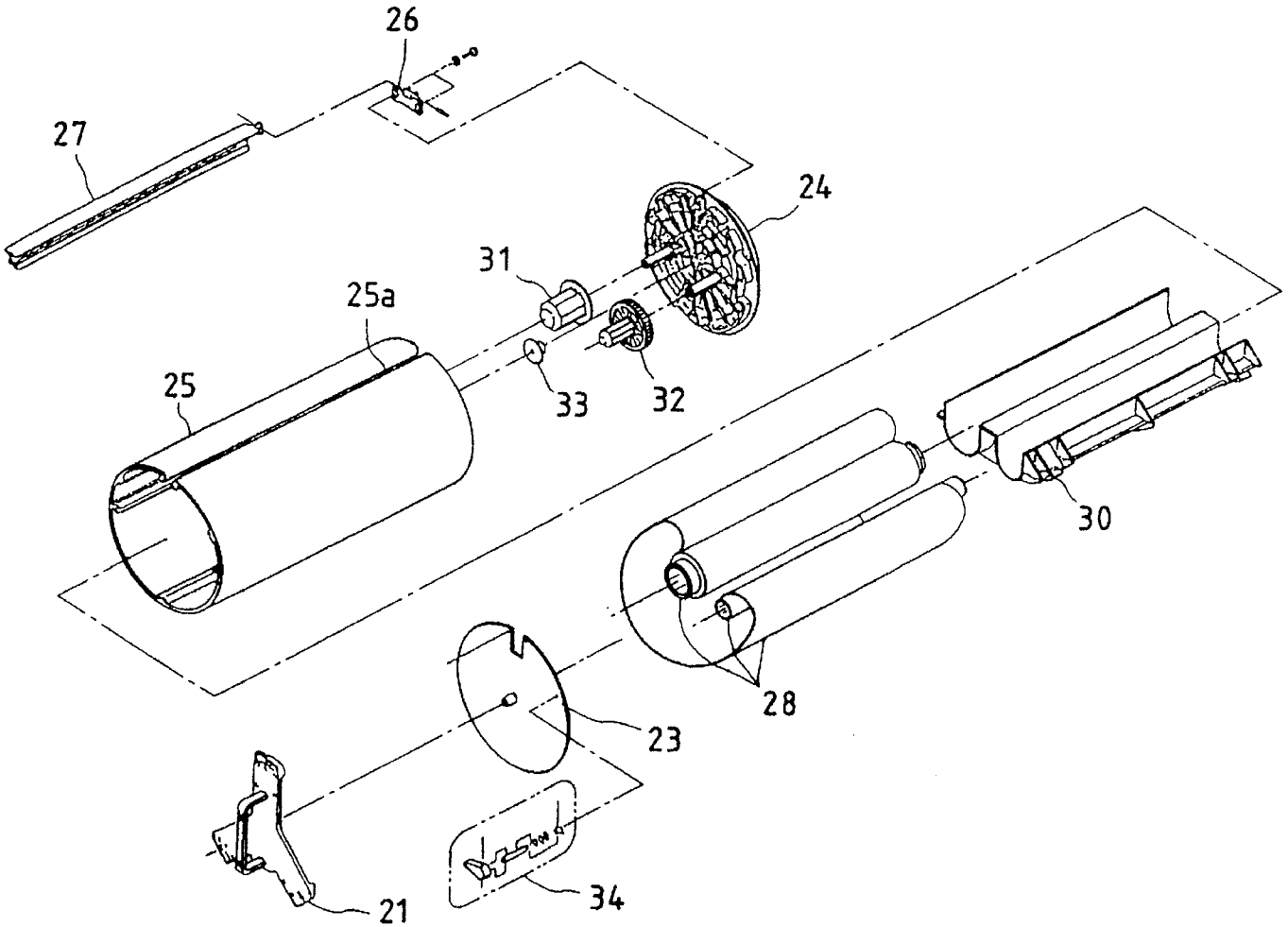
FIG. 3 is an exploded view in perspective showing the construction of a take-up type photoreceptor unit.

As shown in FIG. 3, the take-up type photoreceptor unit 4a is made up of a tubular base 25, the rear cap 24 attached to the rear end of the tubular base 25, a narrow opening 25a cutting apart the base along a line extending in the longitudinal direction thereof, a bar-like cap 27, having grooves on both sides, for closing the narrow opening 25a therewith, a cap hinge 26 joining the bar-like cap 27 and the rear cap 24 so that the bar-like cap 27 is turned against the tubular base 25, a stock sprocket 31 for supporting and driving a photoreceptor film roll assembly 28, a take-up gear 32, a take-up drive gear 33, a guide holder 30 serving as a guide means in setting the photoreceptor film roll assembly 28 into the photoreceptor unit, a front cap 23 arranged to close the front end of the tubular base 25, a tension lever assembly 34 for pressing a photoreceptor film on the circumferential outer surface of the tubular base 25, and a front frame 21.

Figure 4:
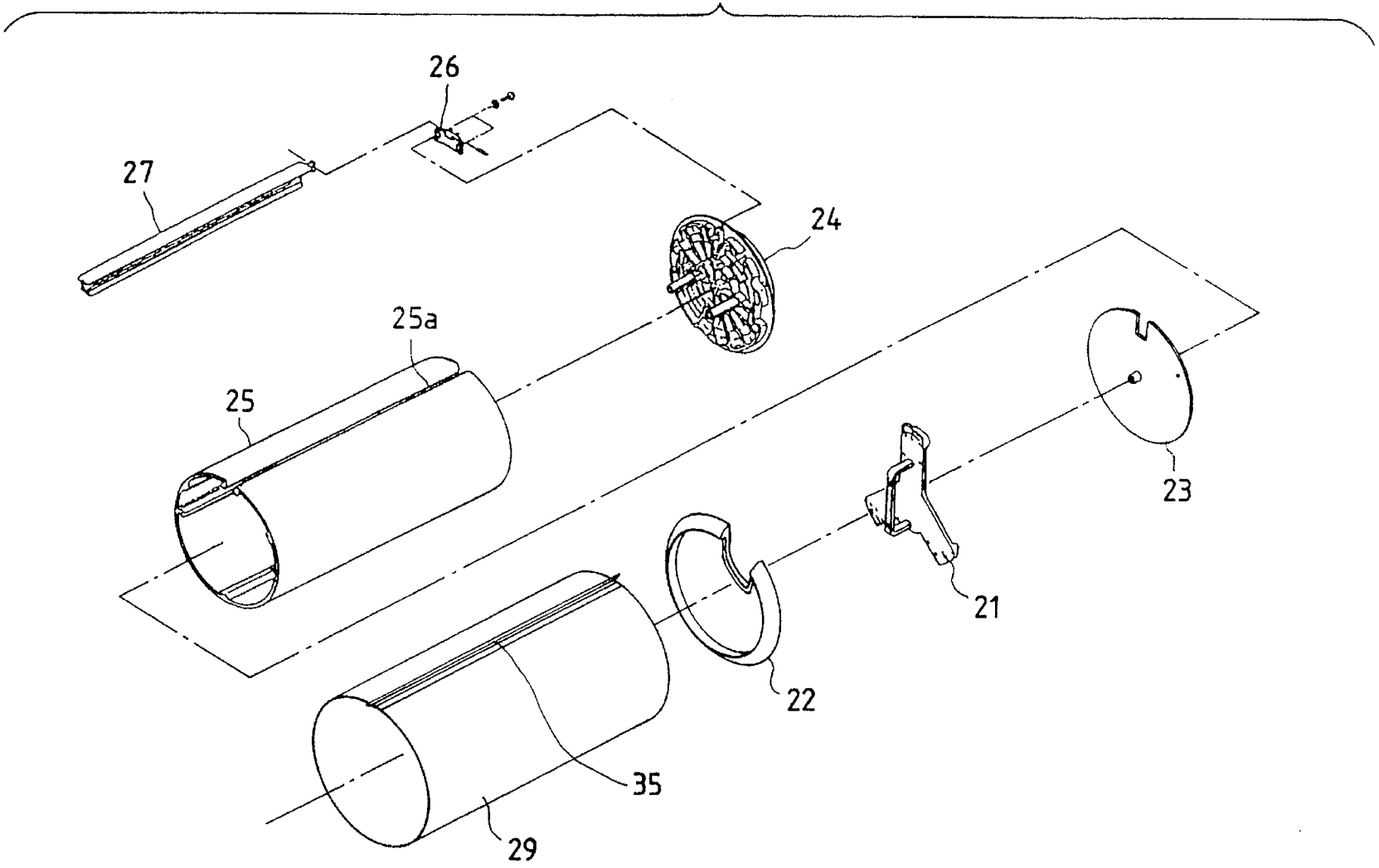
FIG. 4 is an exploded view in perspective showing the construction of a clamp type photoreceptor unit.
Figure 7A:
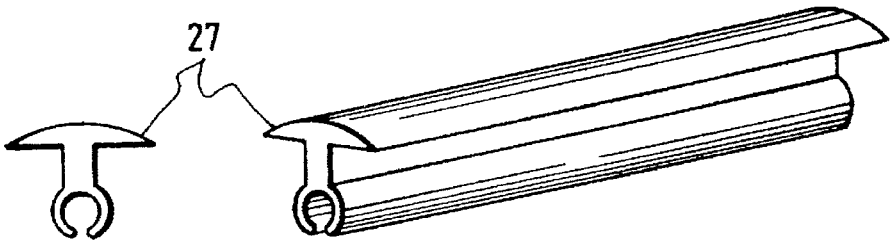
FIGS. 7(*a*) and 7(*b*) are explanatory diagrams showing the constructions of a cap and a guide bar, respectively.
Figure 7B:
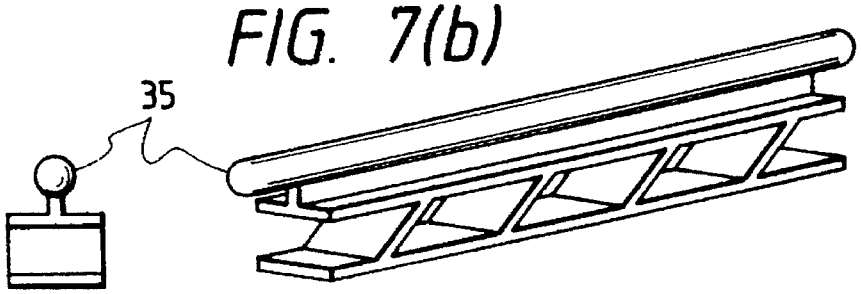

As shown in FIG. 4, the clamp type photoreceptor unit 4b, like the take-up type photoreceptor unit 4a, is made up of a tubular base 25, a rear cap 24, a hinge 26, a bar-like cap 27, a front cap 23, and a front frame 21. The rear cap 24 forms a photoreceptor supporting means which is provided commonly to both the take-up type photoreceptor unit 4a and the clamp type unit 4b. An endless film assembly 29 having the circumferential length, which is longer than that of the tubular base 25 by a predetermined length, is used for the photoreceptor. The endless film assembly 29 is fitted to the tubular base 25 in such a way that the bar-like cap 27 is turned upward about the hinge 26, the endless film assembly 29 is opened by a tapered guide ring 22 attached to the front frame 21, a guide bar 35 is inserted into an elongated groove formed in the bottom of the bar-like cap 27 (see FIG. 7(*a*)), up to a predetermined position, and the bar-like cap 27 is turned toward the narrow opening 25a of the bar-like cap 27 and clamped thereto. The guide bar 35, as shown in FIG. 7(*b*), has an elastic structure in the lower part. With the elastic structure, when the bar-like cap 27 is closed, the guide bar 35 presses the photoreceptor against the tubular base 25. In the present embodiment, the guide bar 35 is a molded product made of ABS resin. To form the elastic structure, the elasticity of the ABS resin is utilized.

Figure 5:
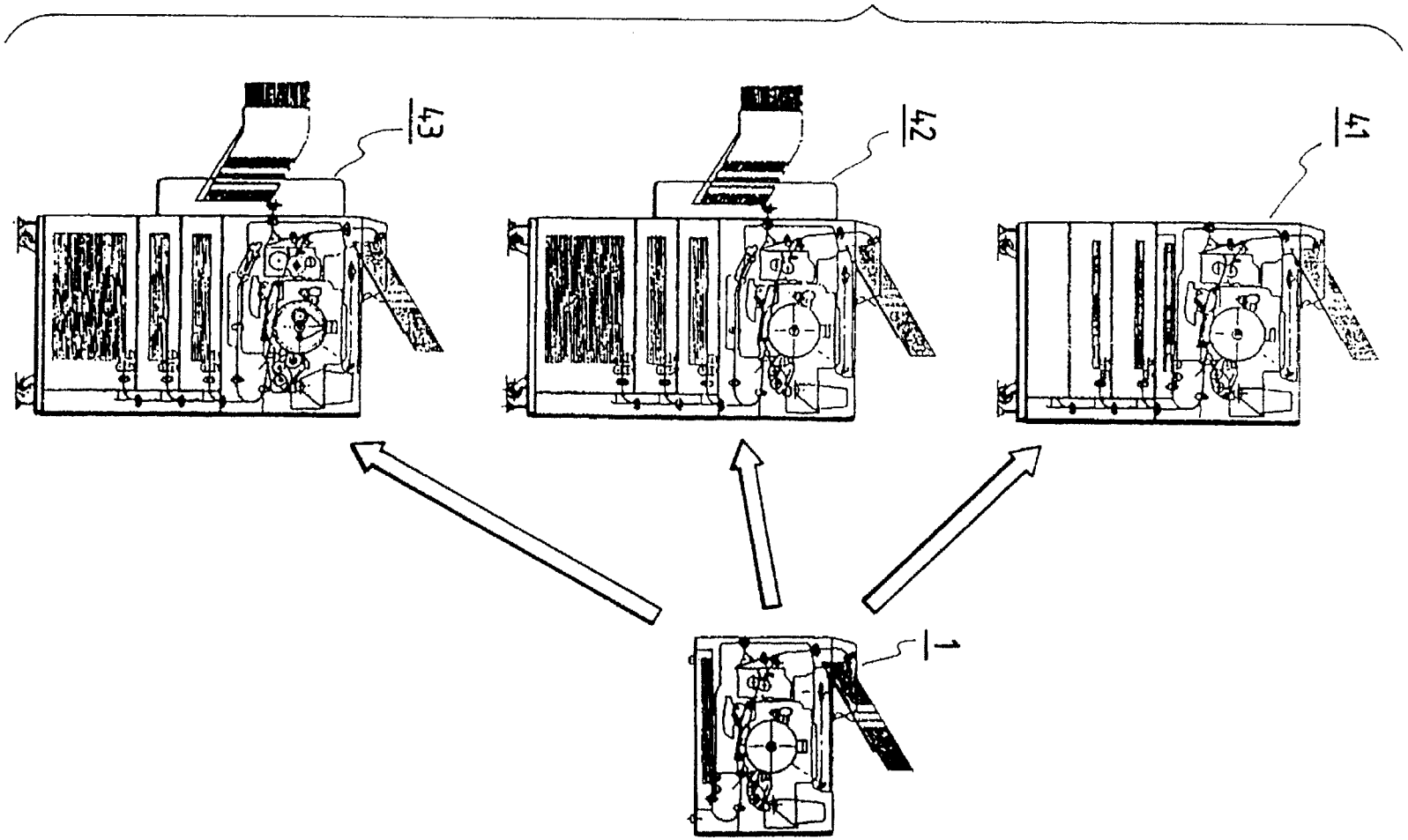
FIG. 5 is a diagram showing a variation of series models of the image forming apparatus.

FIG. 5 is a diagram showing a variety of series modules of the image forming apparatus. In this instance, several models of the image forming apparatus having different printing speeds and different duties are constructed on the basis of the base machine 1. The clamp type photoreceptor unit 4b is used for the photoreceptors of image forming apparatuses 41 and 42 of 26 PPM (page per minute) and 40 PPM in printing speed. The take-up type photoreceptor unit 4a is used for the photoreceptor of an image forming apparatus 43 of 60 PPM.

Figure 6:
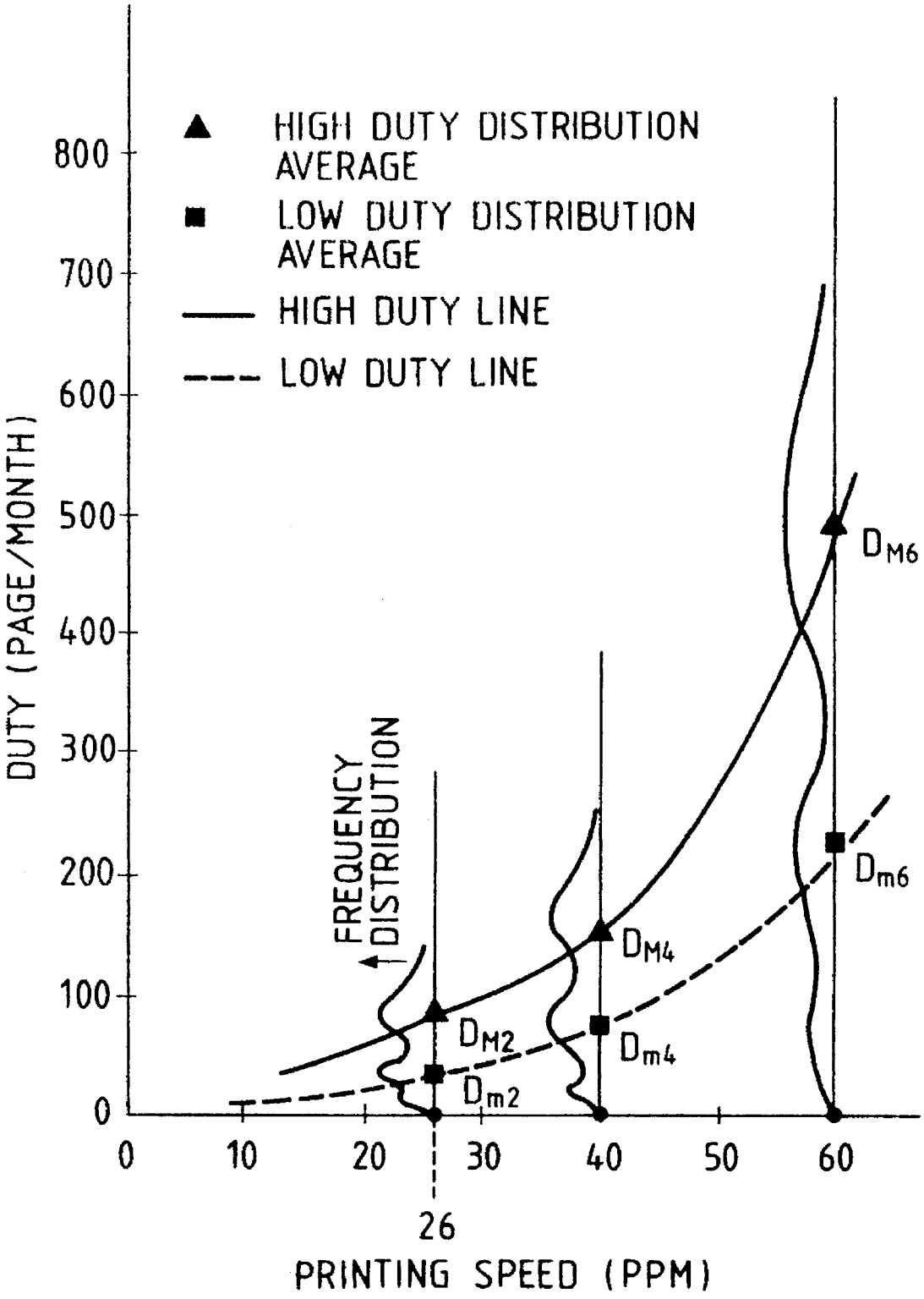
FIG. 6 is a graph showing the relationship between duty and printing speed.

FIG. 6 is a graph showing the relationship between duty and printing speed. In the graph, the abscissa represents the printing speed (PPM) and the ordinate represents the duty (K page per month). Frequency distributions of duty are plotted for the printing speeds 26, 40 and 60 PPM of those models. The frequency distributions having their mean values in a relatively low duty for the distribution processing and in a relatively high duty for the central processing are depicted in the graph. The former mean value is called the mean value of a low duty distribution. A dotted line connecting those mean values indicates a low duty line. The latter mean value is called the mean value of a high duty distribution. A solid line connecting these mean values indicates a high duty line.

Figure 8A:
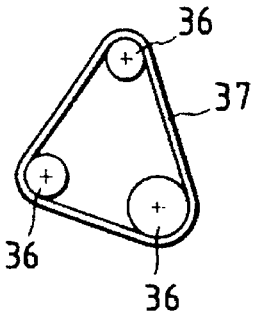
FIGS. 8(*a*) and 8(*b*) are diagrams showing the construction of a photoreceptor unit used in another embodiment of the present invention.
Figure 8B:
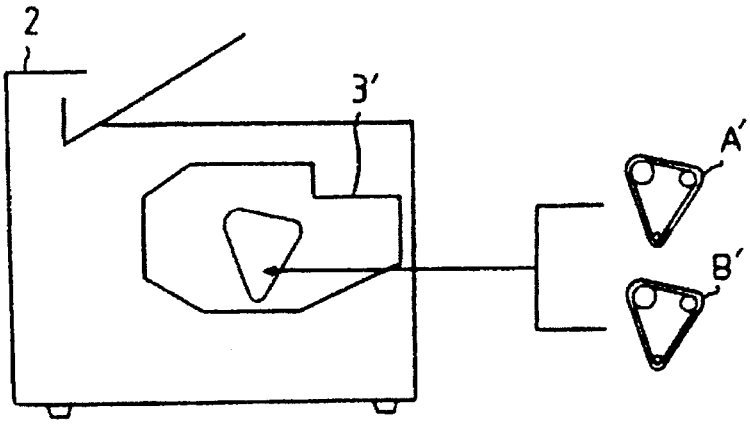

The image forming apparatus thus far described uses the photoreceptor units of the tubular type, such as the take-up type photoreceptor unit, the clamp type photoreceptor unit, and the drum type photoreceptor unit. It is evident that other types of photoreceptor unit may be used in addition to those of the tubular type. The photoreceptor units of the belt type in which photoreceptor belts 37 are wound around rollers 36 as shown in FIGS. 8(*a*) and 9(*a*) may also be used. Plural types of the belt-type photoreceptor units are selectively used in accordance with the specifications of the image forming apparatuses used.

More specifically, in the case of using the belt-type photoreceptor shown in FIGS. 8(*a*) and 9(*a*), since the form of the photoreceptor unit is different from that of the drum type photoreceptor units 4a and 4b, a single print module 3 cannot be commonly used therefor.

Figure 9A:
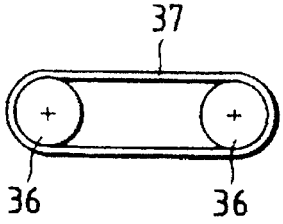
FIGS. 9(*a*) and 9(*b*) are diagrams showing the construction of another photoreceptor unit used in yet another embodiment of the present invention.
Figure 9B:
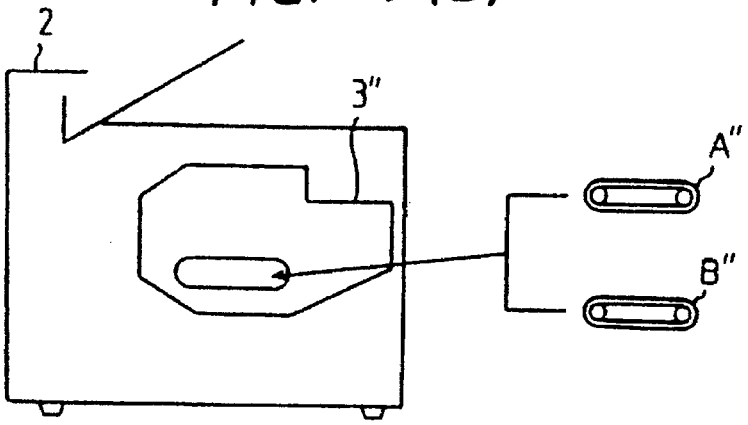

Therefore, in the case of using the photoreceptor unit of the type shown in FIG. 8(*a*), a print module 3' exclusive for that unit is prepared (see FIG. 8(*b*)), and in the case of using the photoreceptor unit of the type shown in FIG. 9(*a*), a print module 3" exclusive for that unit is prepared (see FIG. 9(*b*)).

As seen from the foregoing description, plural types of photoreceptor units, which are interchangeably set to the base machine of the image forming apparatus, are used for the photoreceptor. Accordingly, it is easy to form a variety of model series of the image forming apparatuses of different printing speeds or duties. Further, many components, such as parts and units, may be constructed as common components for those models of the image forming apparatus. This leads to reduction of the cost of production.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical explanation to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising an image forming apparatus body, a plurality of different types of photoconductor units, said different types of photoconductor units being defined by photoconductor units which are different in a mounting structure for mounting a photoconductor layer on a photoconductor base, and mounting means for interchangeably mounting said different types of photoconductor units in said image forming apparatus body, wherein a single type of photoconductor unit is mounted in said image forming apparatus body at one time.

2. A method of supplying a photoconductor unit in an image forming apparatus having an image forming apparatus body, comprising the steps of:

providing a plurality of different types of photoconductor units which are different in a mounting structure for mounting a photoconductive layer on a photoconductor base;

providing mounting means for interchangeably mounting said different types of photoconductor units in said image forming apparatus body, wherein a single type of photoconductor unit is mounted in said image forming apparatus body at any one time;

selecting any one of said plurality of different types of photoconductor units; and assembling the selected one of said photoconductor units into the image forming apparatus body.

3. An image forming apparatus, comprising:

a base machine; and mounting means for interchangeably mounting a plurality of different types of photoconductor units to said base machine, wherein a single type of photoconductor unit is mounted to said base machine at any one time, said different types of said photoconductor units having different internal configurations so as to have at least one of different printing speeds and different duties, while having external configurations of substantially the same dimensions.

4. The image forming apparatus according to claim 3, wherein said mounting means comprises a print section module detachably mounted on said base machine wherein each one of said plurality of different types of photoconductor units is operative to be removably set to said print section module.

5. The image forming apparatus according to claim 3, wherein said plurality of different types of photoconductor units includes a take-up type photoconductor unit, a clamp type photoconductor unit, and a drum-type photoconductor unit.

6. The image forming apparatus according to claim 3, wherein at least one of said plurality of different types of photoconductor units comprises a belt-type photoconductor unit.

7. The image forming apparatus according to claim 5, further comprising photoconductor supporting means which is provided commonly to both said take-up type photoconductor unit and said clamp type photoconductor unit.

8. The image forming apparatus according to claim 4, wherein said mounting means further comprises an interface through which each one of said plurality of different types of said photoconductor units is freely and commonly mounted to said print section module and in turn on said base machine.

9. The image forming apparatus according to claim 8, wherein said interface is a mechanical interface comprising power transmission means removably set.

10. The image forming apparatus according to claim 8, wherein said interface is an electrical interface including signal transmission means.

* * * * *